US005947762A

United States Patent [19]

Katsuma

[11] Patent Number: 5,947,762

[45] Date of Patent: Sep. 7, 1999

[54] ELECTRICAL CONNECTOR WITH WIRE COVER

[75] Inventor: Takatoshi Katsuma, Yokkaichi, Japan

[73] Assignee: Sumitomo Wiring Systems, Ltd., Japan

[21] Appl. No.: 08/964,610

[22] Filed: Nov. 5, 1997

[30] Foreign Application Priority Data

Nov. 5, 1996 [JP] Japan ..... 8-292613

[51] Int. Cl.[6] ..... H01R 13/58

[52] U.S. Cl. ..... 439/468; 439/157; 439/902

[58] Field of Search ..... 439/468, 157, 439/902, 460, 464, 470

[56] References Cited

U.S. PATENT DOCUMENTS 5,593,309 1/1997 Post et al. ..... 439/157

5,672,078 9/1997 Fukamachi et al. ..... 439/902

*Primary Examiner*—Neil Abrams

*Assistant Examiner*—T C Patel

*Attorney, Agent, or Firm*—Banner & Witcoff, Ltd.

[57] ABSTRACT

A latching member has a flange provided so as to extend along the inner face of an electric wire cover. This flange shields a space between an edge of a cut away of the cover and the external peripheral face of the latching member, thereby ensuring that the interior of the cover does not open out directly towards the exterior. Due to this, water is prevented from entering the interior of the electric wire cover.

7 Claims, 5 Drawing Sheets

ELECTRICAL CONNECTOR WITH WIRE COVER

TECHNICAL FIELD

The present invention relates to an electrical connector having an electric wire cover attached to the rear face of a connector housing.

BACKGROUND TO THE INVENTION

A prior art lever-type connector provided with an electric wire cover is shown in FIGS. 10 and 11 of the accompanying drawings.

This comprises a connector housing 1 having a plurality of terminal fittings (not shown) connected to electric wires (not shown), an electric wire cover 2 that brings together and guides in a lateral direction the plurality of wires extending from a posterior face 1A of the connector housing 1, a lever 3 attached pivotably to the connector housing 1 in order to facilitate an operation whereby a corresponding connector (not shown) is fitted to the connector, and a locking member 4 formed on the connector housing 1 for retaining the lever 3 in a final fitting position. When the lever 3 is pivoted to the final fitting position, latch projections 3A of the lever 3 fit into locking holes 4A of the locking member 4, resulting in the retention of the lever 3.

In a lever-type connector, in order to reduce the operating force on the lever 3 while maintaining high operability, the change in curvature of a cam groove of the lever 3 (not shown) can be reduced. However, maintaining a specified cam stroke while reducing the change in curvature requires that the angle of rotation of the lever 3 be increased. In order to keep the angle of rotation of the lever 3 large, the locking member 4 is not located at the upper face of the connector housing 1 but on the rear face 1A thereof.

Since the electric wire cover 2 is arranged to be attachable to the rear face 1A of the connector housing 1, means have to be adopted in order to avoid interference between the locking member 4 and the electric wire cover 2. As the locking member 4 must fit with the lever 3, it cannot be housed inside the electric wire cover 2. As a result, the cover 2 has a cut-away 2A provided thereon so as to avoid interference with the locking member 4. The locking member 4 faces outwards from this cut-away 2A.

However, when the cut-away 2A is provided on the electric wire cover 2, as shown in FIG. 11, a space S forms between the edge of the cut-away 2A and the external peripheral face of the locking member 4. Consequently, there is a possibility of water entering through the space S into the cover 2.

The present invention has been developed after taking the above problem into account, and aims to water-proof in a simple manner the space located on the rear face of the connector housing, this space being formed between the protruding member and the electric wire cover.

SUMMARY OF THE INVENTION

According to the invention there is provided an electrical connector assembly comprising a housing having electrical wires protruding from one face thereof, and a cover attachable to the housing to cover said wires, the housing having a projection from said face and the cover having a cut away to accommodate said projection with clearances, wherein the connector assembly further includes shielding means for shielding said clearance.

The shielding means prevents direct passage of moisture past the cover to the interior of the housing. The shielding means may be provided on the housing, on the cover, or partly on the housing and the cover. It may comprise a flange covering the clearance, and may be in close abutting contact. Protrusions of the cover and housing may interleave or interengage so as to provide a tortuous path for moisture or a tight sealing relationship.

BRIEF DESCRIPTION OF DRAWINGS

Other features of the invention will be apparent from the following description of preferred embodiments, shown by way of example only in the accompanying drawings in which.

DESCRIPTION OF PREFERRED EMBODIMENTS

Figure 1:
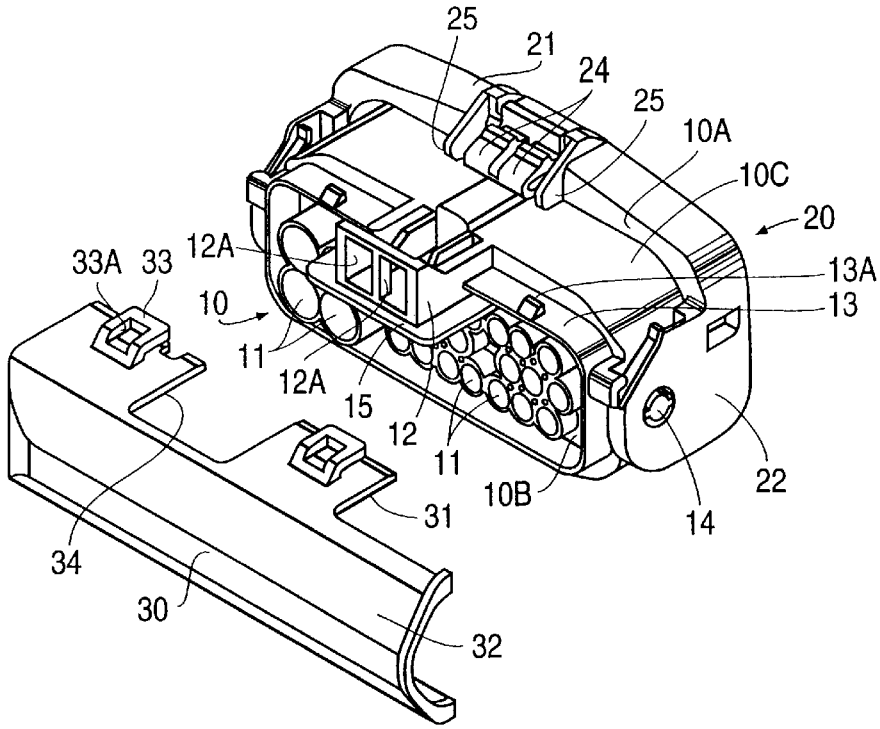
FIG. 1 is a diagonal view of a first embodiment of the invention showing an electric wire cover separated from a connector housing.
Figure 2:
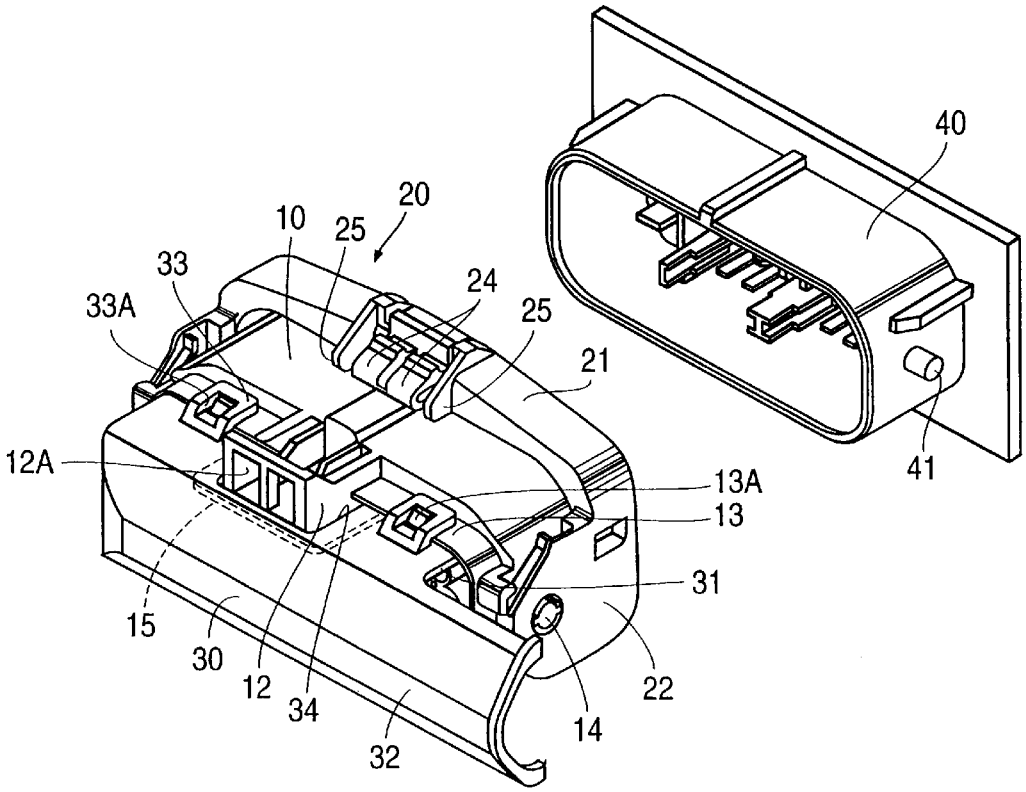
FIG. 2 is a diagonal view corresponding to FIG. 1 and showing the cover attached to the housing.
Figure 3:
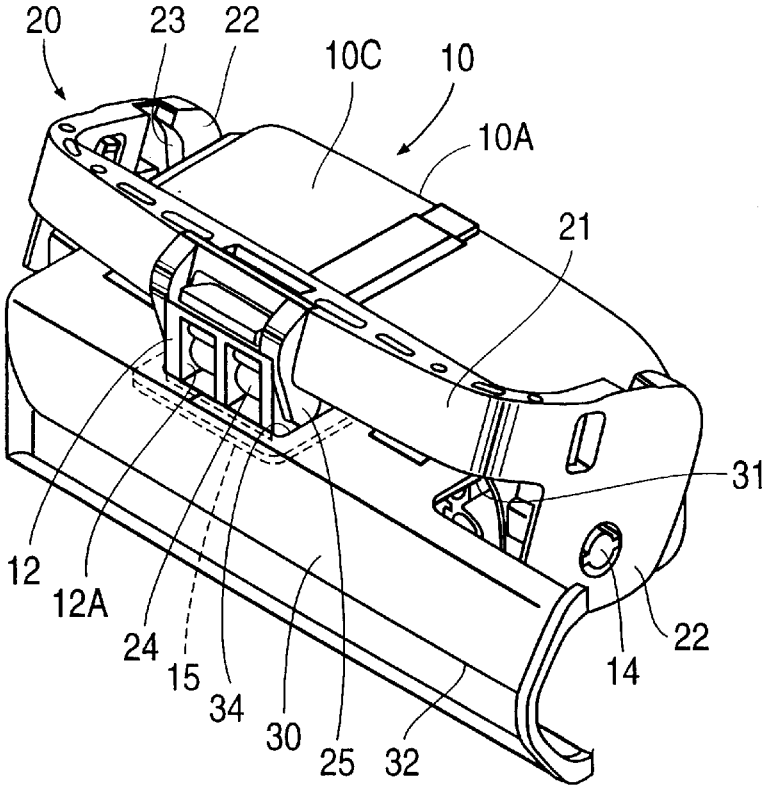
FIG. 3 is a diagonal view corresponding to FIG. 2 and showing the lever rotated to a fitting position.
Figure 4:
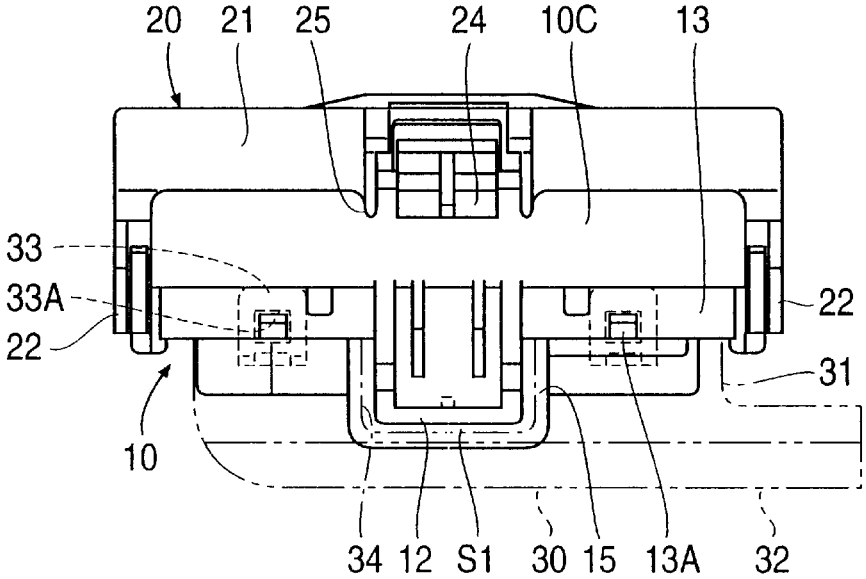
FIG. 4 is a plan view of the first embodiment showing the cover attached to the housing.
Figure 5:
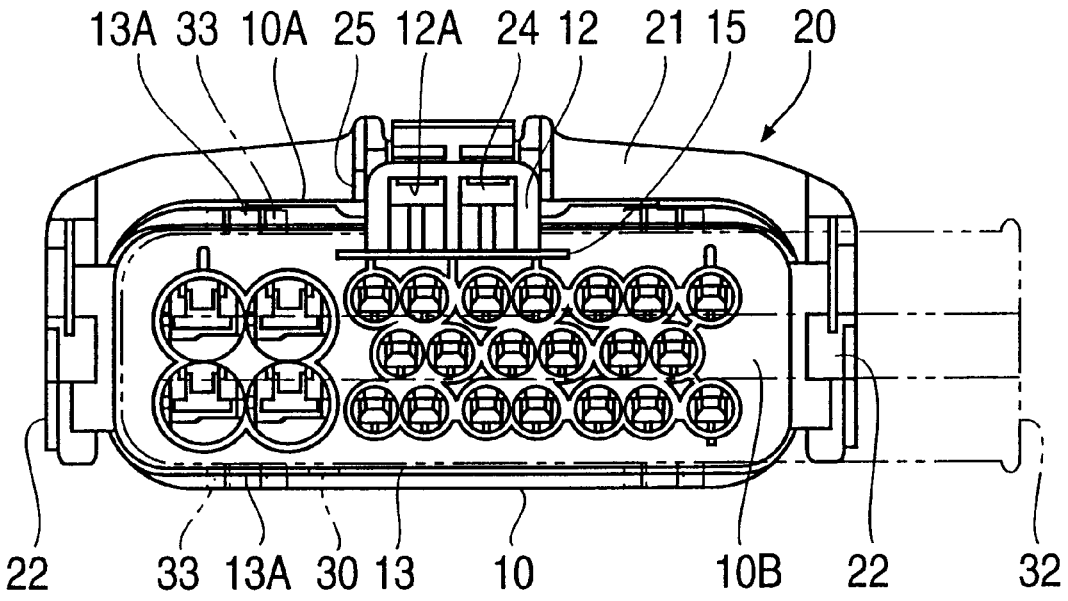
FIG. 5 is a front view of the first embodiment showing the attached cover.
Figure 6:
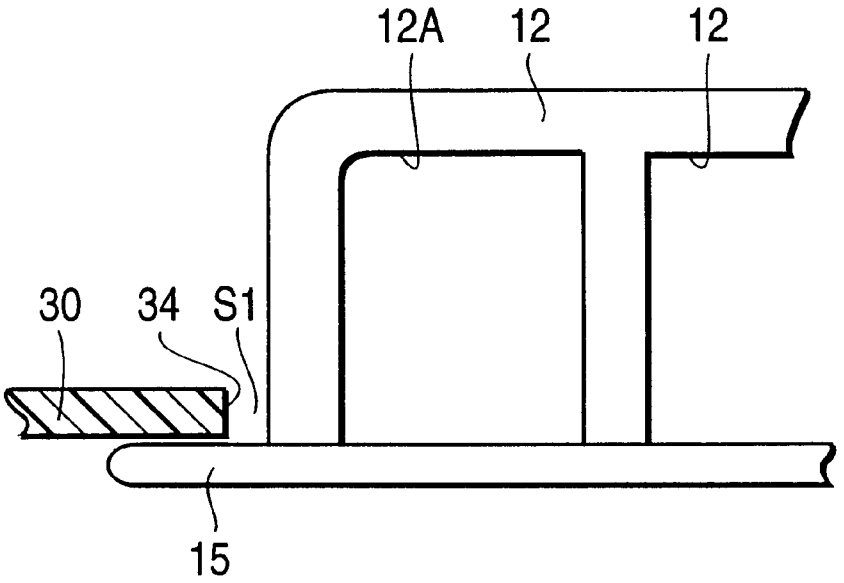
FIG. 6 is a partially enlarged front view of a shielding means of the first embodiment.

Embodiment 1 of the present invention is explained hereinbelow, with reference to FIGS. 1 to 6.

A connector comprises a connector housing 10, a lever 20 and an electric wire cover 30. The connector housing 10 has a plurality of cavities 11 formed so as to open out on a front face 10A (the face fitting with a corresponding connector), and a rear face 10B (the face opposite to the front face 10A), a terminal fitting (not shown) being housed in each cavity 11. Electric wires (not shown) fixed to the terminal fittings extend from the rear face 10B of the connector housing 10, and protrude sideways with respect to the rear face 10B by being bundled and guided together by the electric wire cover 30.

The rear face 10B of the connector housing 10 has a locking member 12 which protrudes therefrom, the locking member 12 serving to fit with the lever 20. This locking member 12 protrudes so as to extend along an upper face 10C of the connector housing 10, and is approximately square when seen from above. The anterior end of the locking member 12 has locking holes 12A, latches 24 of the lever 20 fitting therewith. The rear face 10B of the connector housing 10 has a peripheral wall 13 which extends along the range of attachment of the cover 30. A portion of the peripheral wall 13 has the locking member 12 positioned thereon, the wall 13 extending from the side faces of the locking member 12. The electric wire cover 30 is fitted on the inner side of the peripheral wall 13. The outer face of the peripheral wall 13 has stopping protrusions 13A for maintaining the electric wire cover 30 in an attached state.

The connector housing 10 has a lever 20 for making the fitting with a corresponding connector 40 easier. The lever 20 has plate-shaped arm members 22 formed in a unified manner on both ends of an operating member 21. By fitting the arm members 22 about a supporting axis 14 of the connector housing 10, the lever 20 straddles the connector housing and is supported pivotably thereon. From the initial state, whereby the operating member 21 rests on the upper face 10C of the connector housing 10 (see FIGS. 1 and 2), if the corresponding connector 40 is brought closer to the connector housing 10, its cam protrusions 41 enter the cam grooves 23 (see FIG. 3) located on the inner faces of the arm members 22. From this condition, if the lever 20 is pivoted towards the rear face 10B, the corresponding connector 40 is pulled towards the connector housing 10 and a fitted state is reached. Further, the lever 20, which has been pivoted to the final fitting position, is prevented from returning to its initial state as its latches 24 fit with the locking holes 12A (see FIG. 3). In this manner, the connector housing 10 and the corresponding connector housing 40 are retained in the final fitting position.

The electric wire cover 30 is attached to the rear face 10B of the connector housing 10. The cover 30 opens out so as to correspond to the rear face 10B of the connector housing 10, and has a guiding outlet 31 formed with respect to the rear face 10B and opening out in a downward direction on the right-hand side in FIG. 1. An eaves-shaped guiding member 32 extends from the open edge of the outlet 31 in the same direction as the direction of opening thereof. The upper and lower faces of the cover 30 have stopping members 33 which have stopping holes 33A. When the cover 30 is fitted with the rear face 10B of the connector housing along the inner face of the peripheral wall 13, the stopping holes 33A and the stopping protrusions 13A fit together, and accordingly the cover 30 is attached to the connector housing 30. The plurality of electric wires are consequently bundled together and bent sideways inside the cover 30, and are guided outwards from the outlet 31 along the guiding member 32 in a sideways direction with respect to the rear face 10B.

The rear face 10B on which the electric wire cover 30 is attached has the locking member 12 protruding therefrom. In order to prevent interference with the locking member 12, the electric wire cover 30 has a square shaped cut-away 34 formed thereon. Due to this cut-away 34, the locking member 12 is exposed to the exterior of the electric wire cover 30 and accordingly the fitting with the lever 20 becomes possible.

The edge of the cut-away 34 is provided so as to extend around the external peripheral face of the locking member 12. However, a space S1 (shown in FIGS. 4 and 6) is formed between the edge of the cut-away 34 and the external peripheral face of the locking member 12, this space S1 being formed in order to avoid interference with ribs 25 protruding on either side of the latches 24. At the inner side of this space S1 is located the cavities 11, and by the means described below, a simple water-proofing is achieved.

The water-proofing comprises a flange 15 which protrudes from the external peripheral faces (the face parallel to the rear face 10B and both the side faces at right angles to it) of the locking member 12 so as to extend along the inner face of the cover 30. A very small space forms between the flange 15 and the inner face of the cover 30. The space S1 between the electric wire cover 30 and the locking member 12 is shielded by means of this flange 15. Accordingly, the inner side of the electric wire cover 30 no longer opens out directly to the exterior. Consequently, even if water falls into the space S1 between the cover 30 and the locking member 12 from the exterior, it is prevented from entering the interior of the cover 30 by means of the flange 15.

In this way, according to the present embodiment, since the flange 15 is provided so as to shield the space between the cover 30 and the locking member 12, water falling into the space S1 is prevented from entering the interior of the electric wire cover 30.

Figure 7:
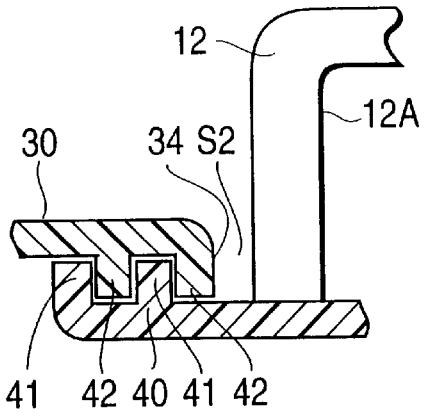
FIG. 7 is a partially enlarged front view of a shielding means of a second embodiment.

Embodiment 2 of the present invention is explained hereinbelow, with reference to FIG. 7.

Embodiment 2 differs from embodiment 1 in that the configuration of the shielding means is different. Since the configuration of the other parts is the same as in embodiment 1, the same numbers are accorded to parts having the same configuration as in the first embodiment, and an explanation thereof omitted.

The shielding means of the second embodiment comprises: a flange 40 extending from an external peripheral face of a locking member 12, two flange protrusions 41 that protrude outwards from the flange 40 towards the inner face of the electric wire cover 30, and two cover protrusions 42 that protrude inwards from the inner face of the cover 30 towards the flange 40. The two protrusions 41,42 comprise draining edges which mesh into each other so that they overlap while having a slight clearance between them. Due to the above configuration, water follows a tortuous path when it begins to enter the interior of the electric wire cover 30 from the space S2, and the seeping distance is consequently longer. Thus, even if the water begins to enter the interior via the flange 40 and the electric wire cover 30, seepage into the interior is prevented. When the flange 40 is approximately horizontal, water is prevented with certainty from seeping in beyond this due to the draining edges of the protrusions 41,42.

Figure 8:
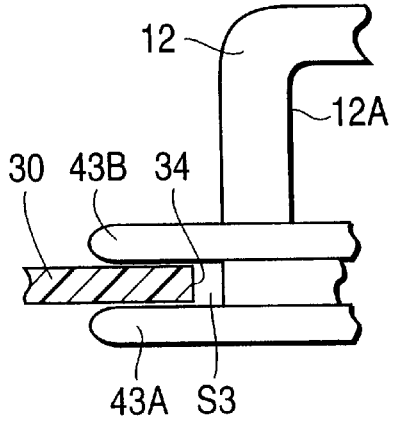
FIG. 8 is a partially enlarged front view of a shielding means of a third embodiment.

Embodiment 3 of the present invention is explained hereinbelow, with reference to FIG. 8.

Embodiment 3 differs from embodiment 1 in that the configuration of the shielding means is different. Since the configuration of the other parts is the same as in embodiment 1, the same numbers are accorded to parts having the same configuration as in the first embodiment, and an explanation thereof omitted.

A shielding means of this embodiment comprise two flanges 43A and 43B protruding from the external peripheral face of the locking member 12. One of the flanges 43A extends along the inner face of the cover 30, and the other flange 43B extends along the outer face of the cover 30. Consequently, the peripheral edge of a cut-away member 34 of the electric wire cover 30 is covered on the outer and inner sides by the flanges 43A and 43B, and can be clamped if required.

Due to the configuration described above, since the space S3 between the electric wire cover 30 and the locking member 12 is covered by the flange 43B on the external side, water can be prevented from entering the space S3. Even if water does enter the space S3, the flange 43A shields the inner side, resulting in prevention of the entry of water into the interior of the cover 30. Since in embodiment 3 two flanges 43A and 43B are provided, the water entry path is arranged to be tortuous as in embodiment 2, thereby making the seeping distance longer. This results in a configuration whereby a superior water-proofing effect is achieved.

Figure 9:
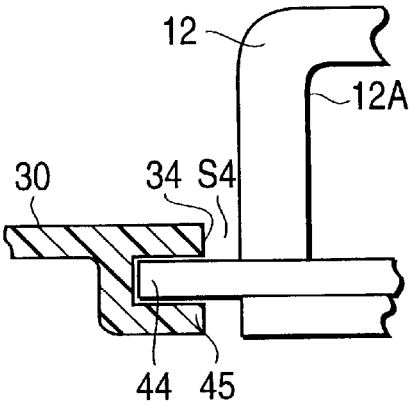
FIG. 9 is a partially enlarged front view of a shielding means of a fourth embodiment.
Figure 10:
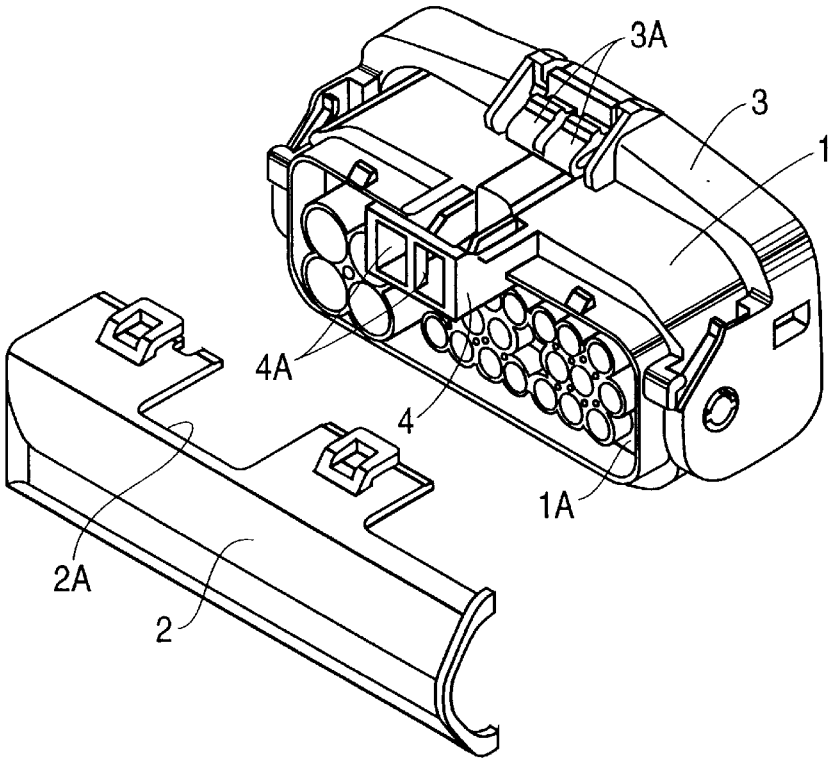
FIG. 10 PRIOR ART
FIG. 10 is a diagonal view of a prior art example showing an electric wire cover separated from a connector housing.
Figure 11:
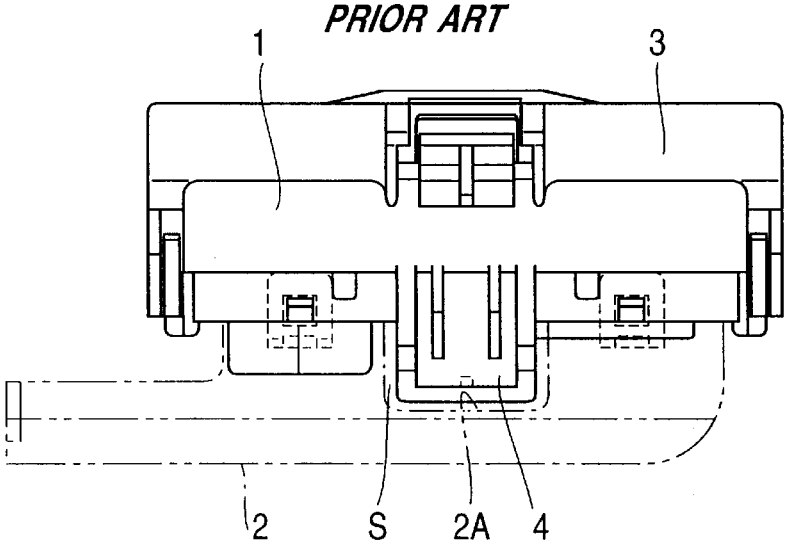
FIG. 11 PRIOR ART
FIG. 11 is a plan view of the conventional example showing an electric wire cover attached to a connector housing.

Embodiment 4 of the present invention is explained hereinbelow, with reference to FIG. 9.

Embodiment 4 also differs from embodiment 1 in that the configuration of the shielding means is different. Since the configuration of the other parts is the same as in embodiment 1, the same numbers are accorded to parts having the same configuration as in the first embodiment, and an explanation thereof omitted.

A shielding means of this embodiment comprises a flange 44 protruding from the external peripheral face of the locking member 12 and extending along the inner face of the cover 30, and a flange 45 protruding from the inner face of the cover 30 and extending along the inner face of the flange 44. In this embodiment, by clamping the flange 44 of the locking member 12, the water entry path is arranged to be tortuous as in the case of embodiments 2 and 3, resulting in a superior water-proofing effect with respect to space S4.

The present invention is not limited to the embodiments described above with the aid of figures. For example, the possibilities described below also lie within the technical range of the present invention. Moreover, the present invention may be embodied in various ways other than those described below without deviating from the scope thereof.

(1) Although in the embodiments described above, a case is described where only one latching member is provided, the present invention also applies in the case where two or more latching members are provided.

(2) Although in embodiment 1 the flange is located only on the inner side of the electric wire cover, in the present invention, it may equally be arranged that the flange shields the space by being provided only on the outer side of the electric wire cover.

(3) In embodiment 2 the flange is located on the inner side of the electric wire cover. However, according to the present invention, the flange may be located on the outer side of the cover, and it may be arranged so that the water draining edge protruding inwards from the flange and the water draining edge protruding outwards from the cover are provided so as to mesh together.

(4) In embodiment 2 there are two flange draining edges and two cover water draining edges each. However, the number of such water draining edges can be freely set to be according to requirements.

(5) The present invention can be applied to connectors other than lever-type connectors which have a configuration that requires a shield for a cover to prevent ingress of water.

I claim:

1. An electrical connector assembly comprising a housing having a face adapted for electrical wires to protrude therefrom, and a cover attachable to the housing to cover the wires, the housing further having a lever and a locking member for receiving the lever, said locking member having at least a portion projecting from said face toward said cover, and the cover having a wall extending toward said face with a cut away to accommodate said projecting portion of said locking member with clearance, wherein the connector assembly further includes a shielding member extending continuously around said projecting portion of the locking member and projecting outward toward said cover to overlap with said wall of said cover for shielding said clearance to inhibit the ingress of moisture into the connector assembly.

2. An assembly according to claim 1 wherein said shielding member comprises a flange of said housing.

3. An assembly according to claim 2 wherein said shielding member extends on the inner and outer sides of said cover wall.

4. An assembly according to claim 1 further including a shielding member provided on said cover.

5. An assembly according to claim 4 wherein said cover shielding member comprises a flange for forming an overlap with said housing shielding member.

6. An assembly according to claim 5 wherein said shielding comprises mutually overlapping protrusions of said flanges, the protrusions defining water draining edges.

7. An assembly according to any preceding claim wherein the projecting portion of said locking member comprises a latching member for cooperation with the lever.

* * * * *